United States Patent [19]

Pritchard et al.

[11] Patent Number: 4,752,263

[45] Date of Patent: Jun. 21, 1988

[54] CUSTOM UNDERWATER DIVING SYSTEM

[75] Inventors: Steven J. Pritchard; Quest C. Couch, III, both of San Antonio

[73] Assignee: Cuda International Corporation, San Antonio, Tex.

[21] Appl. No.: 626,291

[22] Filed: Jun. 29, 1984

[51] Int. Cl.[4] ..... B63C 11/30

[52] U.S. Cl. ..... 441/88; 224/153; 405/186; 128/202.14

[58] Field of Search ..... 441/88, 96, 136, 80; 405/185-187; 224/153, 205, 209; 128/202.14

[56] References Cited

U.S. PATENT DOCUMENTS

| | | | |
|---|---|---|---|
| 40,114 | 9/1863 | McKeen | 405/186 |
| 2,968,159 | 1/1961 | Edmund | 405/186 |
| 2,982,105 | 5/1961 | Akers | 405/186 |
| 3,090,205 | 5/1963 | Hurwitz | 405/186 |
| 3,090,345 | 5/1963 | Hulbert | 405/186 |
| 3,105,359 | 10/1963 | Ellis | 405/186 |
| 3,135,098 | 6/1964 | Root | 405/186 |
| 3,536,071 | 10/1970 | Ferrando | 441/96 |
| 3,670,509 | 6/1972 | Walters | 114/315 |
| 3,842,611 | 10/1974 | Anderson | 405/186 |
| 3,861,731 | 1/1975 | Young | 114/221 R |
| 3,877,098 | 4/1975 | Braly | 405/186 |
| 3,891,131 | 6/1975 | Tabata | 405/186 |
| 3,964,266 | 6/1976 | Bartlett | 441/96 |
| 4,009,583 | 3/1977 | Buckle | 405/186 |
| 4,016,616 | 4/1977 | Walters | 405/186 |
| 4,054,132 | 10/1977 | Deeds | 441/96 |
| 4,068,657 | 1/1978 | Kobzan | 405/185 |
| 4,114,389 | 9/1978 | Bohmrich et al. | 405/186 |

*Primary Examiner*—Joseph F. Peters, Jr.
*Assistant Examiner*—Stephen P. Avila
*Attorney, Agent, or Firm*—Andrew S. Viger

[57] ABSTRACT

An integrated custom underwater diving system including backpack, weight system, bouyancy compensator, and equipment bag. The backpack has adjustable shoulder supports for conforming to the shape of the shoulders and torso of a diver and an integral weight system having a quick-release mechanism. The equipment bag has a plurality of compartments for storing and safely transporting diving equipment, the back and ends of which are provided with a semi-rigid sheath for protecting the contents of the bag during shipping, and compartments along the sides thereof for receiving diving fins which provide protection along the sides of the bag during shipment. The backpack is designed for removably mounting on the front of the equipment bag such that the backpack provides protection to the front of the bag during shipping and handling. The equipment bag is also provided with straps which allow the bag to be carried on the backpack to and from dive sites. The buoyancy compensator of the present invention is removably mounted to the backpack for diving, and is in the shape of an elongated inverted "U" designed for two configurations of use. In the standard front position, the ends of the buoyancy compensator are buckled in front of the diver's torso. That configuration permits an easy face-down supine swimming position with minimum restriction to the diver's movements. That configuration also allows the diver to float head-up on the surface of the water. In the optional back position, the ends of the buoyancy compensator are buckled behind the diver's torso. That configuration further facilitates a supine swimming position with little or no obstruction in front of the diver and further provides a streamlined profile reducing the amount of effort necessary for swimming.

20 Claims, 8 Drawing Sheets

CUSTOM UNDERWATER DIVING SYSTEM

BACKGROUND OF THE INVENTION

The present invention is an integrated underwater diving system including backpack, weight system, bouyancy compensator, and equipment bag. The system is particularly useful for Scruba diving.

Scuba diving has attracted the attention and interest of a diverse and wide-spread segment of the population. Equipment has become safer and easier to use in recent years, with the consequence that more and more people annually are adopting diving as a sport. Divers now can enjoy a variety of diving experiences, including reef exploration, deep diving, wreck diving, drift diving, underwater photography, shell collection, spear fishing, cave diving, and treasure hunting.

Although diving can be enjoyed in virtually any inland lake, river or other body of water, divers, particularly sport divers, as a group generally prefer the warmer, clear waters of such areas as the Carribean, South Pacific, Red Sea, the waters off Micronesia, Australia and New Zealand, to name but a few. Unless a diver is fortunate enough to live in one of these areas, it is generally necessary for a diver to travel to a desirable dive location by airline, ship or a combination of both.

Accordingly, divers must pack all the equipment necessary for diving, such equipment including regulators, masks, fins, snorkel, wetsuits, and the like, into a bag, carry the bag to the airport or embarcation point, check the bag through the airline or other common carrier, and upon arriving at the destination, again carry the bag and diving paraphanelia to the hotel or other lodging. In addition, each day a typical diver must carry all of the necessary diving equipment from the place of lodging to the dive boat, and at the end of the day from the dive boat to the place of lodging.

Numerous dive bags and equipment bags, of course, are available on the market. Most such bags, however, provide no protection whatsoever for the rough handling typically encountered in transporting baggage through an airline or other common carrier. Additionally, such bags are typically bulky and difficult to carry, and provide no system for readily organizing diving equipment within the bag. Moreover, insofar as the inventors are aware, no dive bags or equipment bags have been specifically designed to integrate with the diving equipment to provide a single, overall transport system.

Additionally, diving equipment itself available to date leaves much to be desired. The equipment is typically heavy, bulky and cumbersome; is difficult to carry through an airport to the dive site and back home; is difficult to pack securely; is difficult to work with on a dive boat, namely stowing the bag, finding equipment and re-packing the bag; is difficult to don; and is generally uncomfortable. Moreover, equipment available today tends to restrict a diver's movement; interferes with the use of underwater photographic equipment; is difficult to ditch in water and on the land; and is generally unattractive. Underwater diving systems available today also typically use harnesses or vest-like bouyancy compensators to allow a diver to carry an air tank or air supply on the diver's back, such as shown in U.S. Pat. No. 3,090,205 to Hurwitz et al; U.S. Pat. No. 1,982,105 to Akers; U.S. Pat. No. 3,135,098 to Root; U.S. Pat. No. 3,105,359 to Ellis; U.S. Pat. No. 3,670,509 to Walters; and U.S. Pat. No. 3,891,131 to Tabata. Such harnesses and vests must be continually adjusted and re-adjusted, and are difficult to get into and out of. Other air tank carriers or backpacks have rigid uncomfortable "shoulder hooks" such as described in U.S. Pat. No. 2,968,159 to Edmund and U.S. Pat. No. 3,842,611 to Anderson.

It is also common in modern day diving to use a bouyancy compensating device. The bouyancy compensating device works in conjunction with a weight system to maintain the diver at neutral buoyancy regardless of depth.

It is known, for example, that different divers have differing natural bouyancies when suited up in typical underwater diving gear. Particularly when a wetsuit is used, divers normally will exhibit some natural positive bouyancy, or, in other words, will float to some degree. In order to counteract that natural bouyancy, divers use varying amounts of weights. The weights are typically lead masses molded in various forms to provide individual weights of one, two, four and six pound weight units. Those weight units are typically molded with slots to enable a diver to carry the weights on a web belt attached about his or her waist. In an emergency requiring an immediate or rapid ascent, divers require the ability to quickly release the weight belt. Thus, weight belts are typically provided with quick-release buckles allowing the diver to detach the weight belt and ascend.

Separate weight belts, however, are cumbersome, difficult to transport, and are not generally carried in equipment bags because the weights will crush or damage other diving equipment in the bag during normal transport. Accordingly, several attempts have been made to provide a means for carrying diving weights in the same unit (backpack or vest) that carries the air tank. Examples are U.S. Pat. No. 2,968,159 to Edmund; U.S. Pat. No. 3,090,205 to Hurwitz et al.; U.S. Pat. No. 2,982,105 to Akers; U.S. Pat. No. 3,135,098 to root; U.S. Pat. No. 3,105,359 to Ellis; U.S. Pat. No. 3,842,611 to Anderson; U.S. Pat. No. 3,670,509 to Walters; and U.S. Pat. No. 3,964,266 to Bartlett. Such units are, at best, rudimentary, however, and have not been widely accepted.

It is also known that as a diver descends he or she is subject to increasing pressure. In sea water, a diver experiences an increase of one atmosphere of pressure every thirty-three (33) feet. That increasing pressure causes a diver to become less and less bouyant as the depth increases. Thus, a diver properly weighted on the surface for neutral bouyancy will become more and more negatively bouyant as depth increases. Divers compensate by wearing bouyancy compensator devices. It is known that bouyancy depends upon the volume of water displaced by a body. Thus, as these bouyancy compensator devices are inflated, more water volume is displaced and the diver becomes more bouyant. Thus, as the diver descends and his or her natural bouyancy decreases, the diver can inflate his or her bouyancy compensator device and maintain neutral bouyancy. Various types of bouyancy compensators are known in the art, for example U.S. Pat. No. 4,068,657 to Kobzan; U.S. Pat. No. 4,114,389 to Bohmrich et al; U.S. Pat. No. 40,114 to McKeen; U.S. Pat. No. 3,090,345 to Hulbert; U.S. Pat. No. 3,964,266 to Bartlett; and U.S. Pat. No. 4,009,583 to Buckle. In some cases, those units attempt to provide bouyancy compensation through air and water chambers which selectively admit air or water. U.S. Pat. No. 3,670,509 to Walters attempts to adjust bouyancy by selectively releasing small amounts of weight pellets.

The bouyancy compensating devices most generally used by divers, however, are inflatable vests similar to inflatable life jackets. Another type of bouyancy compensator currently on the market is a so-called back type wherein an inflatable device is carried on the diver's back. A third type of bouyancy compensating device typically used is an inflatable device carried around the diver's neck and chest, generally referred to as a "horsecollar", and is similar to the commonly known "Mae West" type life vest.

The bouyancy compensators of the prior art and those available currently, however, have suffered from a number of disadvantages. First, the vest-type bouyancy compensators constrain a diver's movements and, because those vests are also designed to carry the weight of the air tank, those vests are subject to strain and distortion out of the water due to the weight of the tank. Moreover, air is contained in the vest throughout an inflatable internal bladder, meaning that air is present both in front of the diver and on the diver's back. That air renders swimming in a face-down supine position more difficult. Additionally, the added bulk of the vest in water, particularly when inflated, not only restricts the diver's movements, but adds mass to the diver's profile. That added mass increases drag with the consequence that more effort by the diver is required to swim through the water. Accordingly, the diver tires out earlier than otherwise necessary.

The so-called back type of bouyancy compensator maintains the air volume at a diver's back thus rendering swimming in a face-down supine position easier than with the vest-type bouyancy compensator device. A disadvantage, however, is that upon surfacing the back type bouyancy compensators float divers in a face-down position; obviously, an undesirable position particularly if the diver was unconscious or injured.

The "Mae West" or horsecollar type bouyancy compensator devices do not provide much bouyancy and, because the inflatable portion is on the diver's chest, restrict swimming in a face-down supine position.

SUMMARY OF THE INVENTION

The custom underwater diving system of the present invention, for the first time, solves those long-felt but unresolved needs in the art. The custom underwater diving system of the present invention recognizes the need and satisfies that need for a diving system designed as an integrated system, and comprises three integrated components: a backpack with an internal weight system, a unique bouyancy compensator which allows for an easy face-down supine position swimming and upright floating at the surface, and a diving equipment bag integrated to work with the backpack to provide a protected bag for transporting dive equipment and an easier way of carrying the dive equipment to the dive site.

The backpack of the custom underwater diving system of the present invention is a polyurethane molded backpack with a metal skeleton embedded therein which allows the backpack to be individually form-fitted and adjusted to follow the contours of an individual diver's shoulders and back. The shoulder supports of the backpack are semi-rigid, and allow for adjustment to fit an individual diver with a unique form fitting tool. Moreover, those shoulder supports are designed such that they fit over one end of the equipment bag and permit the backpack to be removably secured to the equipment bag for transport which not only allows for an integrated equipment transport system, but allows use of the backpack as a means for protecting equipment inside the bag from handling abuse. The backpack is also designed to provide a single buckled closure for securing the unit to the diver and to the equipment bag.

The backpack further contains cavities for individual weights of the standard type. Unlike some of the prior art units, no specially designed weights are necessary. The weight cavities of the backpack of the present invention have weight release doors which can be quickly opened and the weights released in the event an emergency ascent is necessary.

The backpack of the present invention also provides a molded seat for securing an air tank, and means for releasably securing the bouyancy compensator of the present invention to the backpack.

The bouyancy compensator of the custom underwater diving system of the present invention is also designed to work as an integrated component of the system. The bouyancy compensator is shaped in the form of an elongated, inverted "U" removably mounted to the backpack behind the diver's torso, and is designed for two operable positions. In the standard position, the arms of the bouyancy compensator are buckled together in front of the diver. A unique bladder and "stay" mechanism automatically urges the bouyancy compensator under the arms and around the waist of the diver when the bladder is inflated. That frontal position allows a diver to maintain a comfortable and safe upright floating position, and may also be used for swimming. At depth, a diver rarely, if ever, maintains the bouyancy compensator completely inflated. The unique design of the present bouyancy compensator allows the air in the normally partially inflated bouyancy compensator to migrate to the back of the diver and facilitates a supine swimming position. Even when fully inflated, the bouyancy compensator provides a "rocking chair" effect serving to permit a supine position swimming, yet retaining the advantage of a head-up floating position on the surface. In its second or back mounted position the arms of the bouyancy compensator are buckled behind the diver's torso. In that position, the bouyancy compensator provides an unencumbered design for the diver, facilitating freedom of movement and use of underwater equipment. Moreover, the bouyancy compensator retains the air at the back of the diver thus further facilitating a face-down supine swimming position. On surfacing, the arms of the bouyancy compensator are simply unbuckled from behind the diver's torso and buckled in the standard or front position to allow upright floating.

The equipment bag of the custom underwater diving system of the present invention is also designed as an integrated component of the system making use of the diving equipment itself to provide a protected, easily carried bag. It contains a semi-rigid, preferably plastic, sheath covering the bottom and both ends of the bag. Narrow pockets are provided along both sides of the bag shaped and designed for insertion of the diver's swim fins to provide protection during shipping for the contents of the bag which are located near the sides. The bag is designed to allow the backpack to fit over the front of the equipment bag during shipping to provide rigid protection to the front of the bag. The backpack and bag are designed such that the backpack can be released from the equipment bag by releasing one buckle. Reversing the backpack and inserting the shoulder support through two loops on the equipment bag allows the diver to carry the entire unit on his or her back through airports or to drive sites. Once at the dive site or on the boat, the backpack can be separated from the equipment bag and used for diving.

The equipment bag of the present invention further provides a unique compartmentalized separation of equipment to safeguard the equipment from abuse during shipping and also to allow ease of access at the dive site. The compartments are sized and arranged to place the most fragile of the items of diving equipment in the most protected position in the bag with the least fragile items of diviing equipment in the least protected position.

It is, therefore, an object of the present invention to provide an integrated diving system consisting of a specially designed backpack having integrated weight cavities, equipment bag, and bouyancy compensator.

It is a further object of the present invention to provide an integrated diving system which allows and provides a protected "shipping package" for transporting dive equipment by common carrier or other means, and also provides easy, hands-free transport of the equipment as necessary.

It is an additional object of the present invention to provide a bouyancy compensator offering the advantage of decreased profile facilitating a diver's movement through the water, with two selectable positions; a first position supporting a diver in a head-up position when floating on the surface of the water, and also useful for supine swimming at depth, and a second position further facilitating face-down, supine swimming with little or no obstruction in front of the diver.

These and other objects, features and advantages of the invention will become evident in light of the following detailed description, viewed in conjunction with the referenced drawings, of a preferred custom underwater diving system according to the invention. The foregoing and the following description of the invention is for exemplary purposes only. The true spirit and scope of the invention is set forth in the appended claims.

DETAILED DESCRIPTION OF THE INVENTION

The integrated custom underwater diving system of the present invention includes a backpack, weight system, bouyancy compensator, and equipment bag. The system works together to provide a compact, lightweight, easy to handle system for both traveling and actual use in diving.

Figure 1:
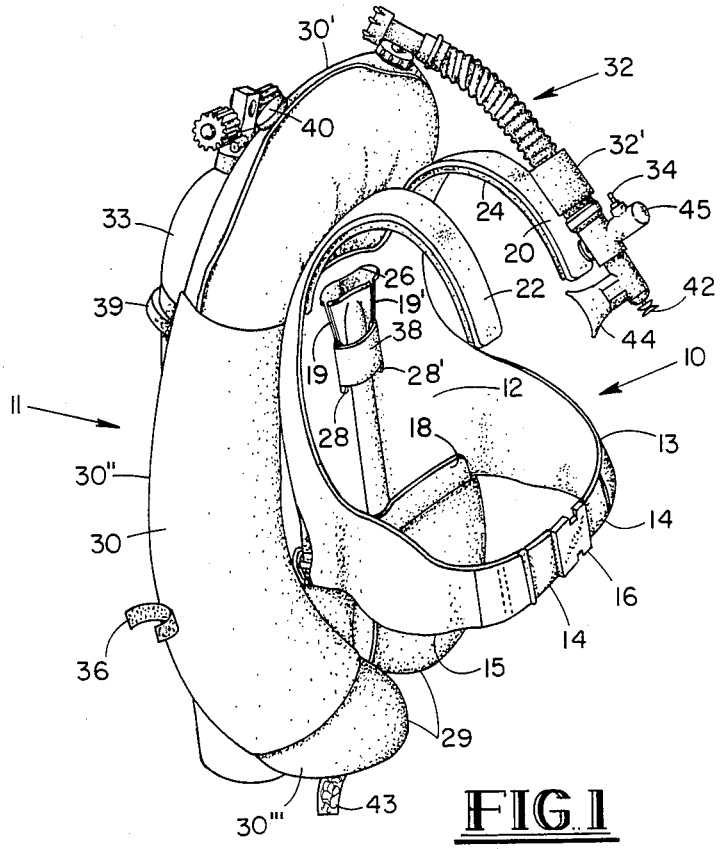
FIG. 1 is a perspective view showing the backpack and bouyancy compensator of the custom underwater diving system of the present invention attached to an air tank with the bouyancy compensator in the optional back position.
Figure 2:
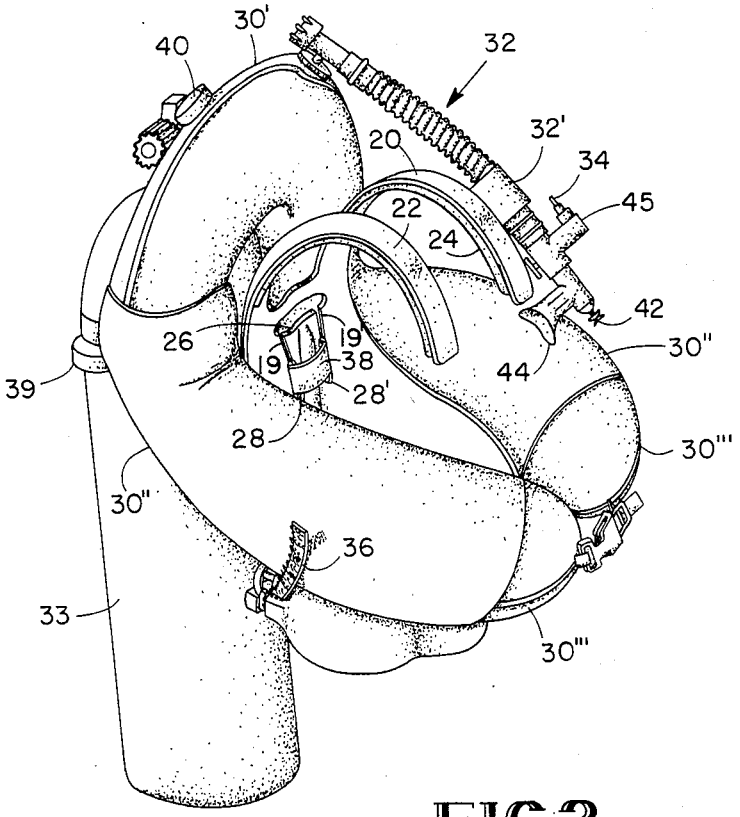
FIG. 2 is a perspective view of the backpack and bouyancy compensator of the present underwater diving system of the present invention illustrating the bouyancy compensator in the front or standard position.

FIG. 1 illustrates backpack 10 integrated with bouyancy compensator 11 shown in the optional back position. FIG. 2 illustrates backpack 10 integrated with bouyancy compensator 11 shown in the standard or front position. Backpack 10 is preferably injection molded in one piece from suitable high-strength, light weight material, for example a polyurethane elastomer material. Backpack 10 is molded to follow the contours of a diver's back with a rear contoured portion 12 and side contoured portions 13 and 15. Two apertures 28 and 28' and upwardly extending slots 19 and 19' are suitably disposed in the upper portion of contoured back portion 12 of the backpack to allow insertion of a web tank strap 38 with latch 39 or other means for securing an air tank 33 to the back of backpack 10. Tank strap 38 is secured to "stays" 54 and 55 removably attached to bouyancy compensator 11, as described below. Thus, bouyancy compensator 11 is releaseably secured to backpack 10 by inserting tank band 38 through slots 19 and 19' into apertures 28 and 28'.

An additional transverse aperture 26 is formed in the upper portion of contoured back 12 of backpack 10 to provide a hand-hold for carrying the integrated system when it is assembled for diving or when the system is integrated with the equipment bag in its shipping position, as described hereinafter.

Shoulder supports 20 and 22 of backpack 10 are individually contoured to the physical build of individual divers. Heretofore, backpacks and diving equipment harnesses have been simply manufactured in one form with little or no provision for conforming the backpack or harness to an individual diver's physical build. Accordingly, prior to the present invention, backpacks have proven to be uncomforable and cumbersome. A principal feature of the present invention is the ability to conform the backpack 10 of the present invention to each individual diver's physical build and in effect tailor the backpack for each diver.

Figure 6:
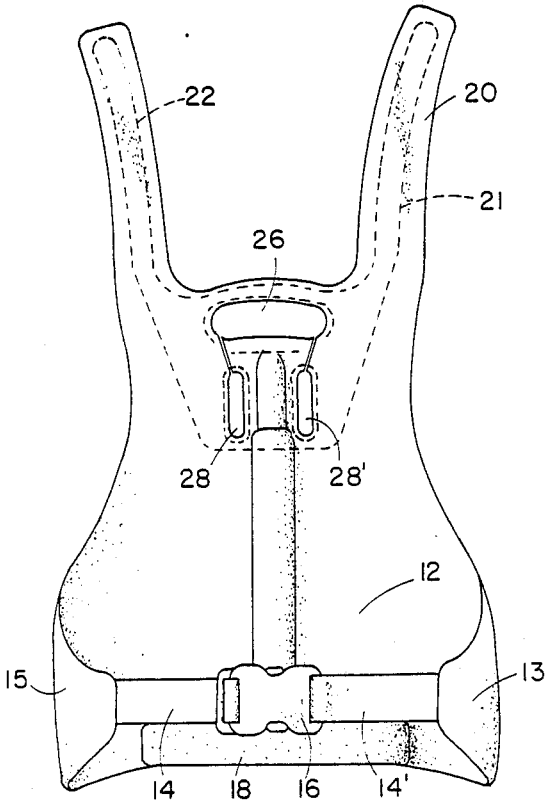
FIG. 6 is a front view of the backpack of the underwater diving system of the present invention illustrating the shoulder supports of the backpack prior to being formed.

Referring to FIG. 6 backpack 10 is manufactured with shoulder , supports 20 and 22 in an extended flattened position. A malleable metal skeleton 21 (shown in phantom lines) is embedded in the material of the backpack in the upper portion thereof as shown in FIG. 6. That metal skeleton 21 provides structural support for the backpack and further reinforces apertures 28 and 28', slots 19 and 19', and hand-hold aperture 26. Metal skeleton 21 in combination with the polyurethane elastomer material from which backpack 10 is preferably made allows shoulder supports 20 and 22 to be formed around the shoulders of individual divers and thereafter retains that form to create a tailor-made system.

Figure 16:
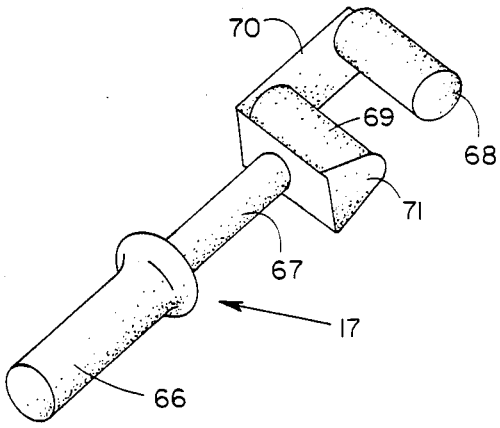
FIG. 16 is a perspective view of a shoulder support forming tool of the underwater diving system of the present invention.

A tool used to form shoulder supports 20 and 22 is illustrated in FIG. 16. Forming tool 17 comprises two cylindrical members 68 and 69 spaced apart and affixed to bar 70. Fixture 71 affixes cylinders 68 and 69 to a suitable length of tubular material 67 and handle 66.

In use, forming tool 17 is disposed about one of the two shoulder supports 20 and 22 with the shoulder support between cylindrical members 68 and 69. Forming tool 17 can thus be used to create smooth curves in shoulder supports 20 and 22 closely matching the physical build of a particular diver.

The open adjustable design of shoulder supports 20 and 21 provide easy donning of the equipment prior to a dive, and easy exit after a dive or in the event an emergency requires a diver to ditch the equipment. That design further provides unencumbered, unobstructed movement for the diver which facilitates use of underwater photographic or other equipment. Moreover, that design integrates with the design of the equipment bag hereinafter described to provide a protected shipping package for the system.

Again referring to FIG. 1, foam pads 24 are disposed on the underside of the shoulder support members 20 and 22 to cushion the backpack and further enhance the comfort of the system.

Figure 8:
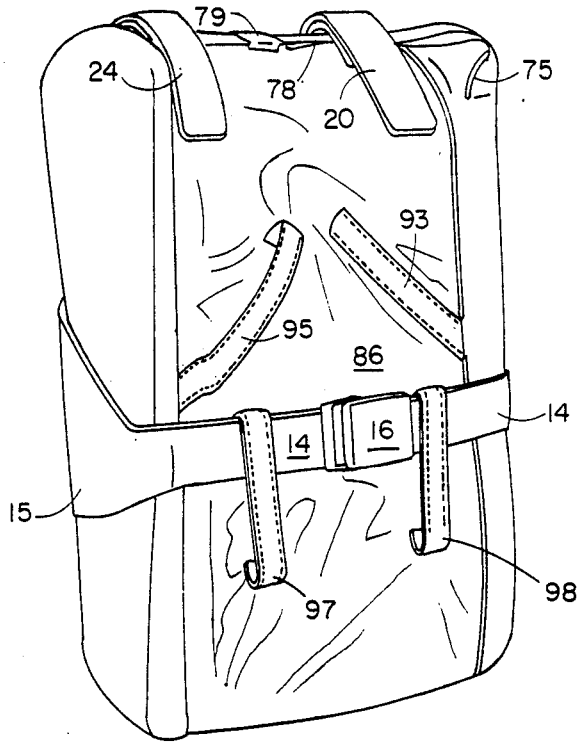
FIG. 8 is a perspective view showing the equipment bag and backpack of the underwater diving system of the present invention in the shipping condition.
Figure 13:
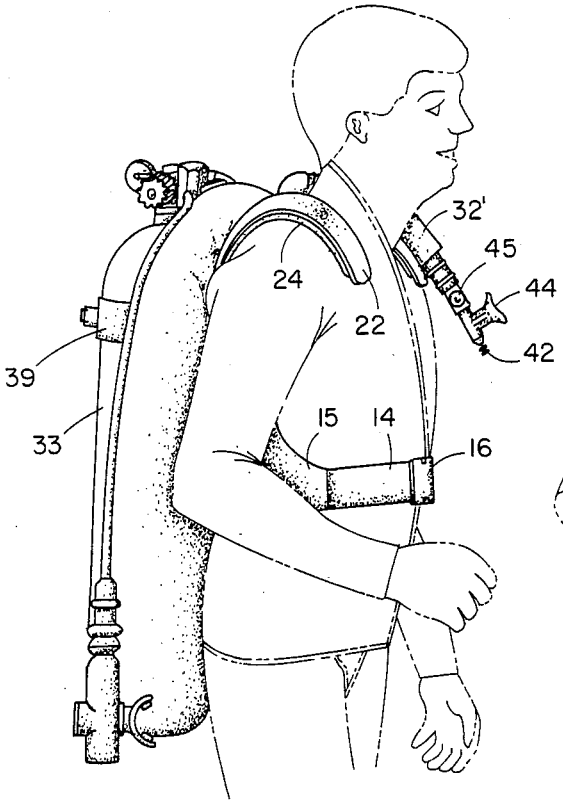
FIG. 13 illustrates the backpack and bouyancy compensator of the underwater diving system of the present invention on a diver in the optional back position.
Figure 14:
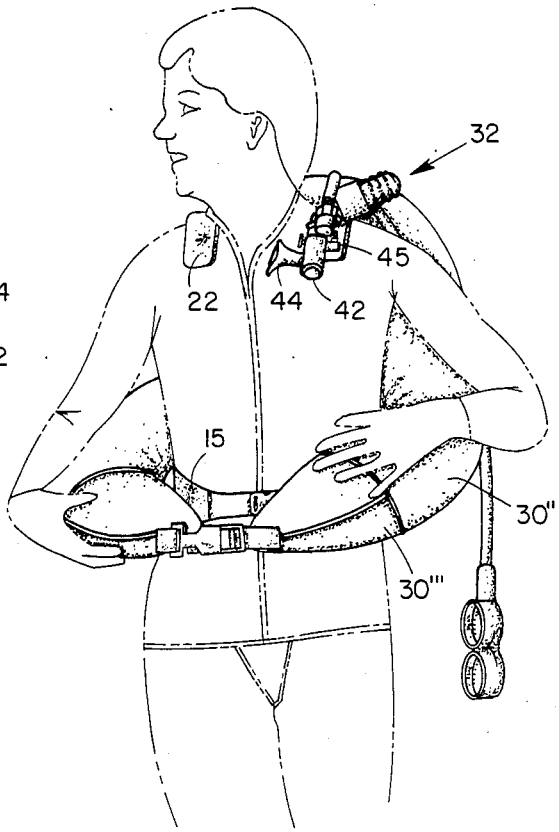
FIG. 14 illustrates the backpack and bouyancy compensator of the underwater diving system of the present invention on a diver in the standard or front position.

Web straps 14 and 14' may either be formed integrally with contoured sides 13 and 15, or otherwise suitably attached thereto. A quick-release buckle 16 is adjustably mounted on straps 14 and 14', and connects the ends of web straps 14 and 14' around the torso of a diver such as shown in FIG. 13 and 14 when the system is in use. As shown in FIG. 8, straps 14 and 14' are also designed to be buckled around the equipment bag of the present invention to provide a protected equipment bag for shipment.

In order to further add comfort to the system, a foam pad 18 is disposed on the lower edge of contoured back 12, and placed so as to rest against the lower back of a diver when the system is in use.

Figure 4:
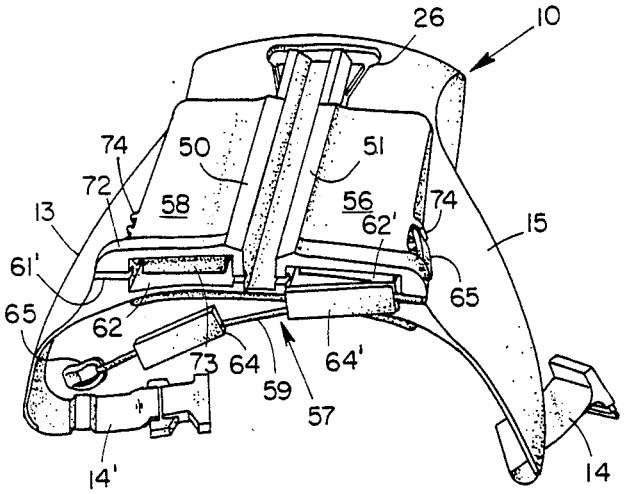
FIG. 4 is a rear perspective view of the backpack of the underwater diving system of the present invention.

Referring to FIG. 4, two parallel chamfered ridges 50 and 51 are formed longitudinally down the back of backpack 10. Those ridges form a cradle for securing an air tank or other air source 33 to the backpack.

Figure 5:
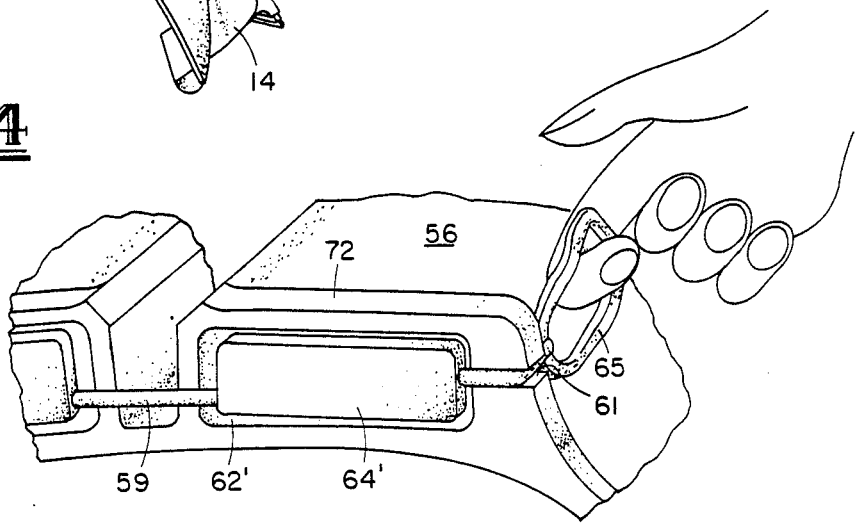
FIG. 5 is an exploded view of the quick-release mechanism for the weight cavities of the backpack of the underwater diving system of the present invention.

Also as shown in FIG. 4, backpack 10 has two (2) integrally formed weight cavities 56 and 58. Although two separate cavities are shown in the preferred embodiment, a single cavity or multiple cavities may be used. Weight cavities 56 and 58 extend approximately half-way up the longitudinal length of backpack 10. Cavities 56 and 58 have lower openings 62 and 62' designed to allow insertion of standard lead dive weights 73 of the type previously carried on weight belts. The weights are retained in cavities 56 and 58 by suitable weight retaining means, such as weight-release doors 64 and 64' and a weight-release door mechanism, indicated generally at 57. As more clearly shown in FIG. 5, weight-release doors 64 and 64' are positioned in openings 62 and 62' in the lower end of cavities 56 and 58 and are sized to retain weights 73 in those cavities. Weight-release doors 64 and 64' are connected by polyurethane elastomer material 59 with molded pull rings 65 at each and thereof. Grooves 61 and 61' are formed in a rim 72 around the lower outer periphery of the walls of the cavities 56 and 58 (as shown in FIG. 5) such that the elastomer material will fit therein. A cooperating detente seat (not shown) on the upper side of the rim 72 and lip 74 (FIG. 4) hold pull rings 65 in position. That detente seat and lip help prevent accidental release during diving when, for example, the diver would brush against coral or other underwater material.

The press fit of the elastomer material in grooves 61 and 61' on both sides of the backpack 10 prevents accidental loss of the weight release doors when the door 64 or 64' on one side of the backpack 10 is released.

In an emergency, a diver may release the weight from the pack by popping pull rings 65 from under lips 74 and pulling up and out as illustrated in FIG. 5. That action will release weight doors 64 and 64' and the weights 73 contained in cavities 56 and 58 will fall out.

Figure 7:
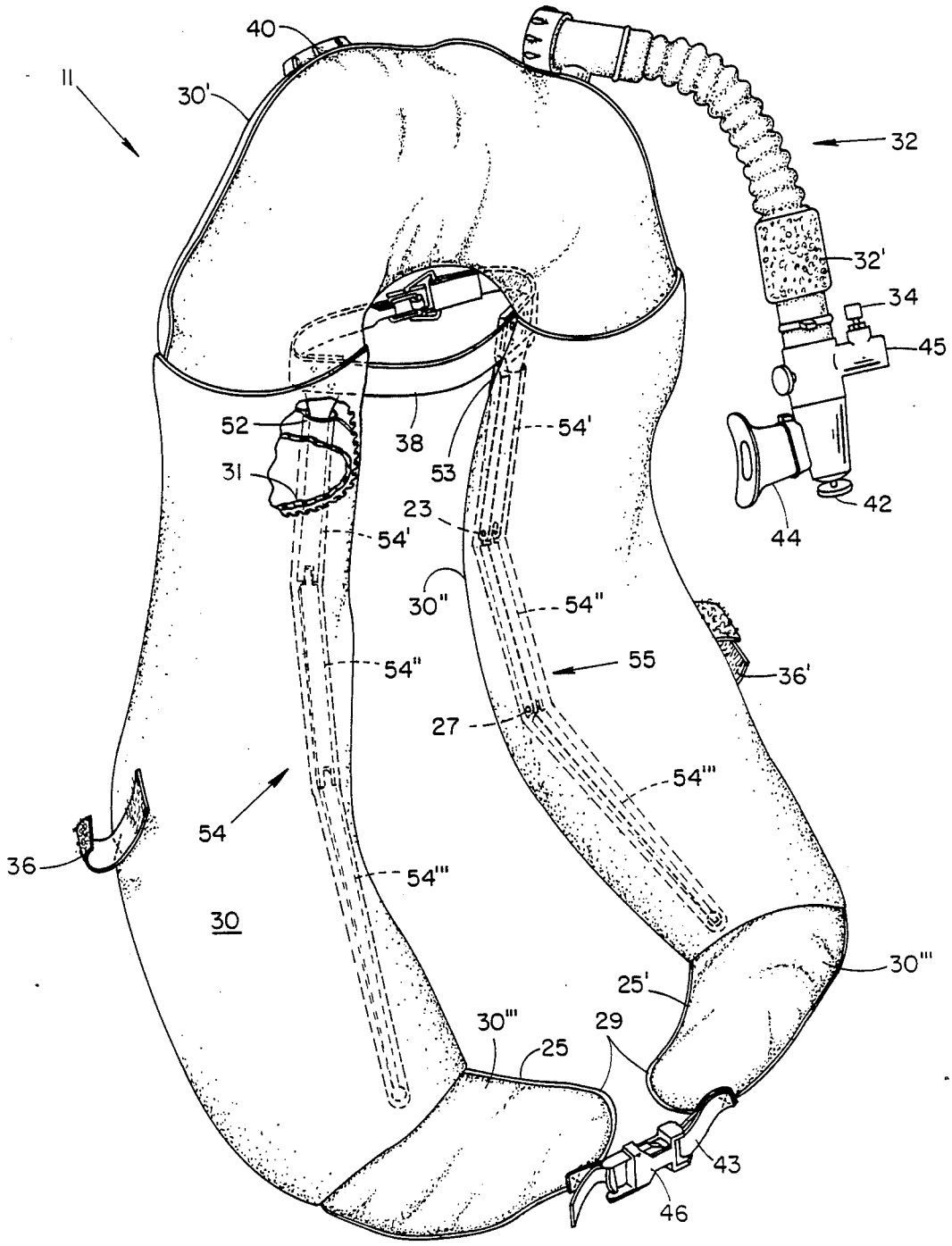
FIG. 7 is a perspective view of the bouyancy compensator of the present invention.

Referring now to FIG. 7, the illustrated bouyancy compensator 11 has a pneumatic chamber or bladder 31 (see FIG. 3) covered by a heavy-weight water resistant canvas cover 30 with an inset section made of stretch nylon material 30''. Although the presently illustrated bouyancy compensator according to the present invention incorporates a separate internal bladder or pneumatic chamber, the bouyancy compensator of the present invention may also be constructed of rubberized canvas or similar material in a one-piece inflatable unit to form a pneumatic inflatable chamber. For ease of explanation, the following description, however, will refer to a bouyancy compensator having a separate pneumatic chamber generally referred to as a "bladder".

When inflated, bouyancy compensator 11 is shaped to conform approximately an elongated inverted "U" increasing in width from top to bottom. The top 30' of the bouyancy compensator cover 30 at the radius of the "U" is preferably made of a water-resistant canvas material and seamed along the interior and exterior of the radius with cording sewn into those seams for strength. On both sides of the bouyancy compensator covering 30 along the legs of the "U", an inset of stretch nylon 30'' is sewn into the canvas and seamed on the inside. That stretch nylon material stretches vertically approximately one hundred percent (100%) and stretches horizontally approximately fifty percent (50%) when the bouyancy compensator bladder is fully inflated.

Extending approximately six (6) inches up from the end of the legs of the "U" shape is another section of canvas 30''' sewn together with seams and cording in the same manner as the upper portion of the bouyancy compensator 30'. At those tips, the cover is sewn to create a slight radius 25 and 25' which brings the two tips of the bouyancy compensator together when inflated as shown in FIG. 1, FIG. 2 and FIG. 14. At the very end of those tips, a water-proof mesh material 29

(on the underside) is inset to allow drainage of the cover and ventilation of the inside of the bouyancy compensator cover. Also attached to the end of the tips is a strip of webbing 43 and buckle 46 which connects the two tips together when fastened.

Figure 17:
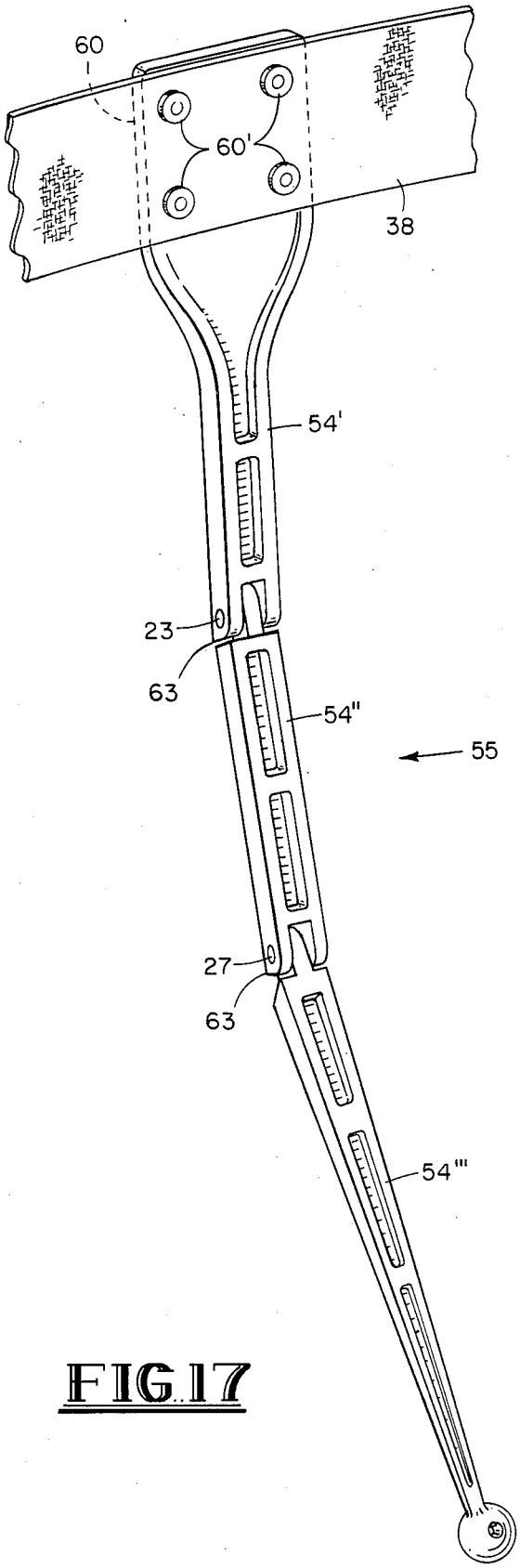
FIG. 17 is a perspective view of the "stays" used in the bouyancy compensator for the present invention.

Two longitudinally extending sleeves, 52 and 53, are formed in cover 30 along the inner sides of the legs of bouyancy compensator 11. Sleeves 52 and 53 are formed to hold "stays" 54 and 55. As must clearly shown in FIG. 17, "stays" 54 and 55 are preferably composed of three sections, 54', 54'' and 54''', joined at pivots 23 and 27. "Stays" 54 and 55, however, may be of any construction which permits a tractable flexion forward around the diver's torso as the bouyancy compensator is inflated. The upper section 54' has an enlarged portion 60 adapted for securing to tank band 38. In the embodiment illustrated, tank band 38 is secured to stays 54 and 55 by rivots 60'. However, any suitable means, including means for releasably securing, may be used to connect tank band 38 to stays 54 and 55. In use, "stays" 54 and 55 are secured to tank band 38 as set out above and inserted in sleeves 52 and 53 in bouyancy compensator cover 30 as shown in FIG. 7. Tank band 38 is then inserted in slots 19 and 19' of backpack 10, as shown in FIGS. 1 and 2, for releasably securing bouyancy compensator 11 to backpack 10. "Stays" 54 and 55 provide structural support to bouyancy compensator 11 by helping to retain the legs of the bouyancy compensator in the extended inverted U-shaped position. Furthermore, the pivoted design of "stays" 54 and 55 facilitate movement of bouyancy compensator 11 between the front and back positions as shown in FIGS. 1 and 2, and FIGS. 13 and 14. In order to prevent bouyancy compensator 11 from moving too far back away from the diver, shoulders 63 are provided at pivots 23 and 27 which limit the backward travel of the stays and hence the bouyancy compensator.

Figure 3:
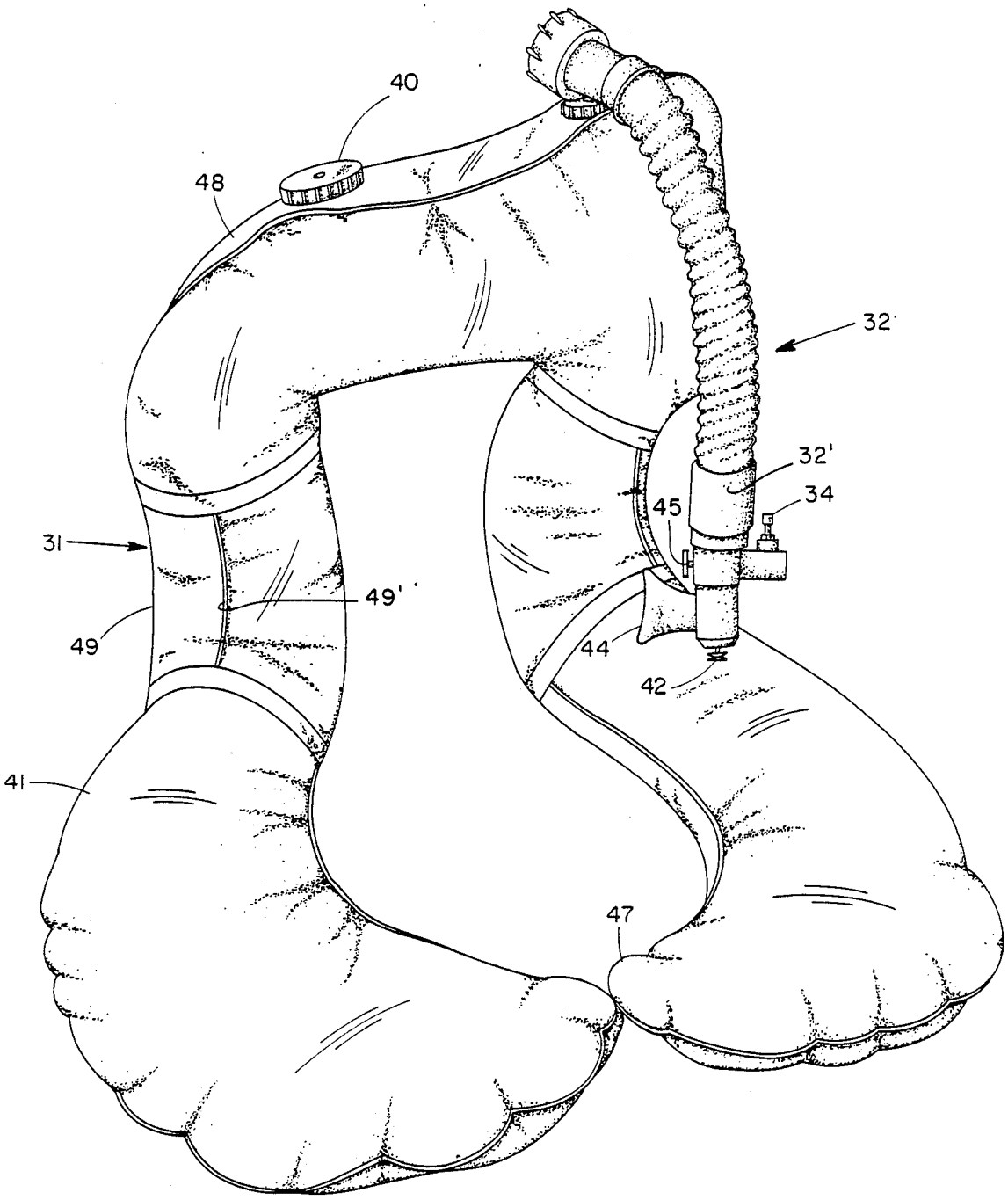
FIG. 3 is a perspective view of the air bladder of the bouyancy compensator of the present invention.

An inflator assembly 32, also shown in FIG. 3, extends through the bouyancy compensator cover 30 and is affixed to the bouyancy compensator bladder 31 for inflation thereof. Inflator assembly 32 is standard, having a connection 34 for a standard hose connection to a low pressure port on the first stage of a standard diving Scuba regulator. The inflation mechanism includes a valve 45 which allows automatic inflation of the bouyancy compensator from air tank 33. A mouthpiece 44 and valve 42 are also provided for oral inflation by the diver. Inflating mechanism 32 may be releasably connected to shoulder support 20 by a Velcro or hook and look fastener 32' (FIGS. 1 and 2). The bouyancy compensator also includes an over-inflation and dump valve 40 to allow release of air from the bouyancy compensator bladder. Additionally, valve 42 can be opened allowing air to escape from the bladder through mouthpiece 44.

Velcro or hook and look fasteners 36 and 36' are preferably sewn to the bouyancy compensator cover on the outside of both legs of the inverted "U" for retaining the standard high pressure hose and auxillary second stage regulator of the standard Scuba diving regulator system.

Referring to FIG. 3, the bouyancy compensator bladder 31 is shaped in the identical shape of the bouyancy compensator cover 30 in the radius area at the top 48 corresponding to the canvas area 30' at the top of the bouyancy compensator cover 30. However, at approximately the same location where the stretch nylon inset 30'' is attached to cover 30, the bladder is formed with an elbow 49. Below elbow 49, the bladder 31 is shaped as shown along its length 41 and at the tip 47 in the same shape with the same radius as bouyancy compensator cover 30''' described above.

Elbow 49 in bladder 31 is shaped with an inner radius 49' shorter than its outer radius on the opposite side of the elbow such that when the bladder is inflated and buckle 46 opened, the lower two-thirds 41 of the bouyancy compensator will automatically move forward around the torso and underneath the arms of the diver (as shown more clearly in FIG. 2 and FIG. 14). The diver can then buckle the tips of the bouyancy compensator together in front of him or her with buckle 46 such that the bouyancy compensator allows the diver to float in an upright and vertical position. In that position, the bouyancy compensator is shaped similar to an elongated automobile innertube attached to the back of the diver and extending around to the front at or above the diver's waist. The stretch nylon insert 30'' in the cover 30 of the bouyancy compensator stretches and "stays" 54 and 55 pivot to allow bladder 31 to take its natural shape in this frontal position resulting from elbow 49 in the bladder. When the bouyancy compensator buckle 46 is unbuckled and the bouyancy compensator is deflated, the bouyancy compensator retracts from the frontal position to a rear position behind the diver as shown in FIG. 13.

In the optional back position such as shown in FIG. 13, buckle 46 secures the ends of the bouyancy compensator behind the diver's torso. The bouyancy compensator may then be inflated as necessary during the dive to maintain the diver at neutral bouyancy. The inflatable bouyancy compensator will be retained on the diver's back facilitating the diver moving in a normal face-down supine swimming position. Upon surfacing, the diver simply reaches behind his back, unbuckles buckle 46, and inflates bouyancy compensator 11 by using inflation mechanism 32, and the elbow 49 in the bouyancy compensator bladder 31 automatically urges the bouyancy compensator forward around the torso and underneath the arms of the diver as shown in FIG. 14. The diver then buckles 46 which allows the diver to float on the surface in a head-up position.

Figure 10:
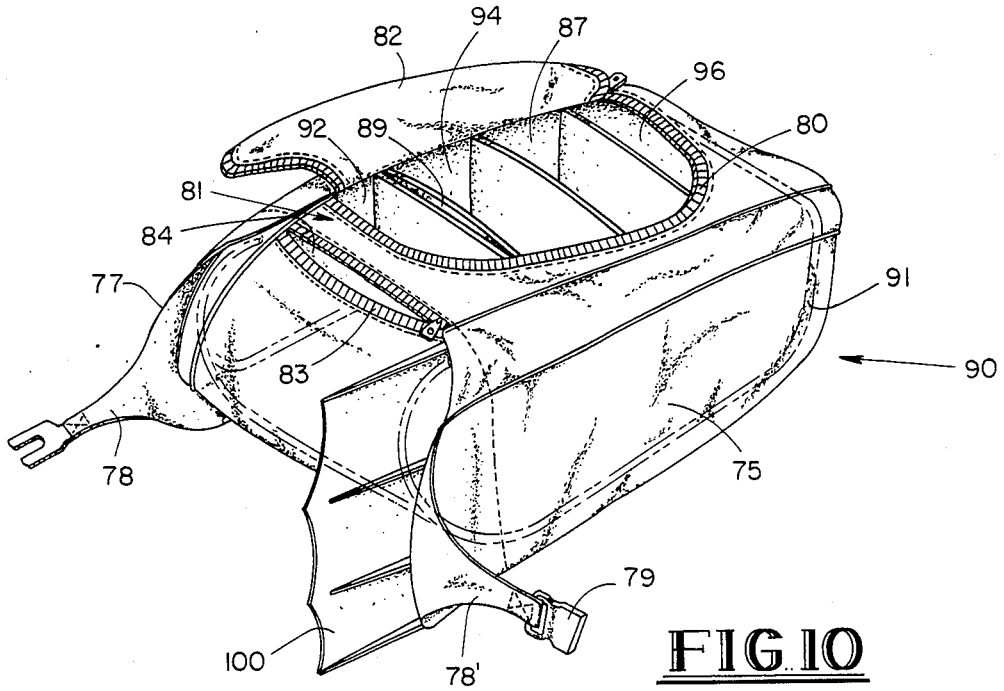
FIG. 10 is a perspective view of the equipment bag of the underwater diving system of the present invention in open condition.

Equipment bag 90 is the third integrated component of the custom underwater diving system of the present invention. Referring to FIG. 10, equipment bag 90 is designed to carry and safeguard all of the standard items of dive equipment used by the majority of Scuba divers, excluding, of course, the air tank. Moreover, equipment bag 90 is designed to organize that equipment by use of compartments in the interior and separate pockets for fins attached to the exterior of the bag.

Equipment bag 90 is preferably made of the same heavy-duty water resistant canvas used to make the cover of bouyancy compensator 30. The shape of equipment bag 90 is rectangular with each end being rounded. The height of the bag is chosen such that shoulder supports 20 and 21 will fit around one end thereof. An ABS plastic or other semi-rigid sheath 91 (shown in phantom lines) lines the bag from the radius at each end of the bag around through the back 86 (FIG. 11) of the bag. As will be seen from the following description, the combination of that sheath 91, the placement of the fins the exterior pockets 75 and 77, and the placement of backpack 10 in the shipping position (FIG. 8) all combine to form a protective sheath around the bag and its contents.

As shown in FIG. 10, the front 81 of the bag has two zippered openings. One zipper 80 closes and opens a half-moon shaped flap 82 running substantially along the length of the bag. The other zipper 83 runs across the width as the bag allowing access to a pocket 84 which has the same width as the bag and is as deep as the depth of the bag. That pocket 84 is designed to hold those items a diver desires to keep dry and separate from those other items of dive equipment that get wet. That pocket 84 is, of course, located at the top of the bag thereby allowing water dripping from wet equipment in the interior of the bag to run downwardly and away from this "dry pocket" 84.

When the half-moon zipper 80 is open and folded back as shown in FIG. 10, the entire interior of the bag is accessible. The interior of bag 90 is preferably made of a water-proof mesh material allowing for ventilation and drainage of the bag. The interior of the bag is compartmentalized into five (5) separate compartments. The first compartment 92 closest to dry pocket 84 is sized and designed for the most fragile items such as diving mask, snorkel, watch and diving gauges. A second compartment 89 is provided with a double layer of mesh material that is designed for items such as dive tables and underwater writing slates. A third compartment 94 below compartment 89 is sized to retain the diver's regulator. A fourth compartment 87 is sized to retain the bouyancy compensator 11. The fifth compartment 96 is sized to retain a diver's rolled-up wetsuit.

Figure 11:
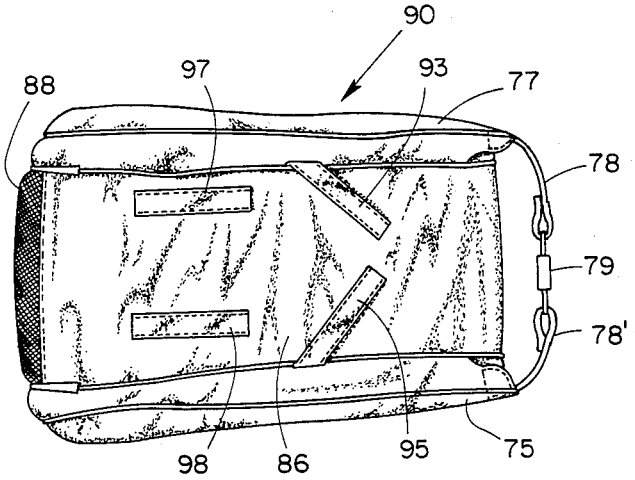
FIG. 11 is a rear view of the equipment bag of the underwater diving system of the present invention.

Thus, equipment bag 90 is designed such that the wettest items, namely the wetsuit and bouyancy compensator, in that order, are located closest to the bottom end of the bag 86 where a strip insert of mesh 88 is inset into the interior canvas material to aid in ventilation and drainage (see FIG. 11). Moreover, the size and placement of the compartments maintain the most fragile of the items of diving equipment in the most protected position in the bag with the least fragile items in the least protected position. Without those compartments, the equipment would not only prove more difficult to store and arrange, but would shift position during transport allowing the fragile items to migrate to a less protected position in the bag.

Figure 12:
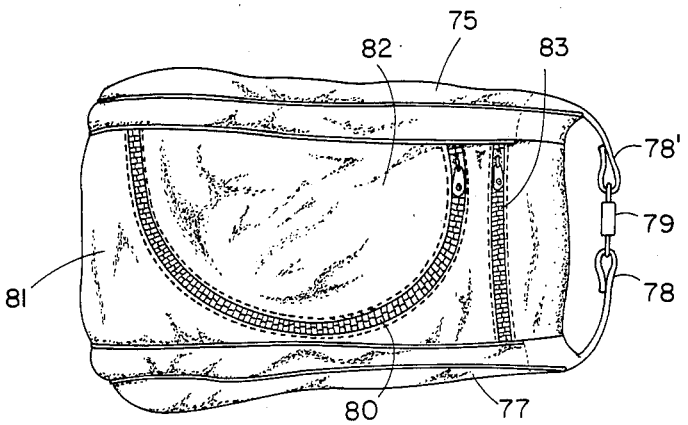
FIG. 12 is a front view of the equipment bag of the underwater diving system of the present invention.

On either side of the bag, pockets 75 and 77 are formed which run the entire length and height of the bag. Those pockets are designed to hold the diver's fins 100. Extending beyond the end of the bag at the opposite end from drainage mesh insert 88 are triangular pieces of material 78 and 78' narrowing to points where a buckle 79 is attached which, when buckled, closes the fin pocket openings. Those flaps 78 and 78' when buckled together, also serve as a handle for carrying the bag as shown in FIGS. 11 and 12. FIG. 12 shows the bag in closed condition.

As covered briefly in the background of the invention above, divers typically must travel to reach dive sites. Accordingly, it is necessary to ship their dive equipment through airlines and shipping companies where the baggage, at best, experiences severe abuse. Diving equipment, particularly regulations, gauges and masks, is relatively fragile and can become damaged or inoperative in shipment. Therefore, one of the principal features of the system of the present invention is to provide a protected environment while in transit.

Referring to FIG. 8 and FIG. 11, as pointed out above, a semi-rigid sheath 91 is incorporated in equipment bag 90 and covers the back 86 of the bag and extends around the radii of curvature on both ends of the bag. Sheath 91 is perforated adjacent mesh insert 88 to allow for drainage from the bag interior. Thus, both ends and the back of the bag have that sheath 91 for protecting the contents in the interior of the bag. When fins 100 are inserted in fin pockets 75 and 77, the sides of the bag are protected by those fins. As shown in FIG. 8, the system of the present invention is designed such that backpack 10 may be placed over the front of equipment bag 90 with web belts 14 and 14' extending through loops 97 and 98 sewn onto the back of equipment bag 90. Buckle 16 is closed thus securely attaching backpack 10 to equipment bag 90.

Now, the system of the present invention forms a shipping case for the diver's equipment securely protecting all sides of the bag. To reiterate, sheath 91 protects the back and ends of bag 90, the fins in fin pocket 75 and 77 protect the sides, and backpack 10 mounted in the shipping position as shown in FIG. 8 protects the majority of the front of equipment bag 90. The only portion of the bag 90 not covered is the lower front portion thereof, namely pockets 87 and 96 which are designed to contain the bouyancy compensator and wetsuit, both flexible items that should not experience damage during shipment.

Figure 9:
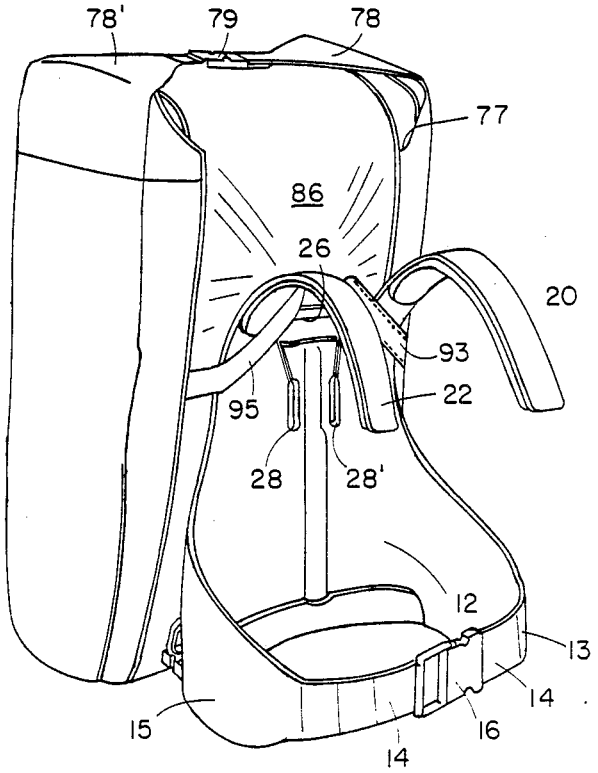
FIG. 9 is a perspective view illustrating the backpack and equipment bag of the underwater diving system of the present invention in the carrying position.
Figure 15:
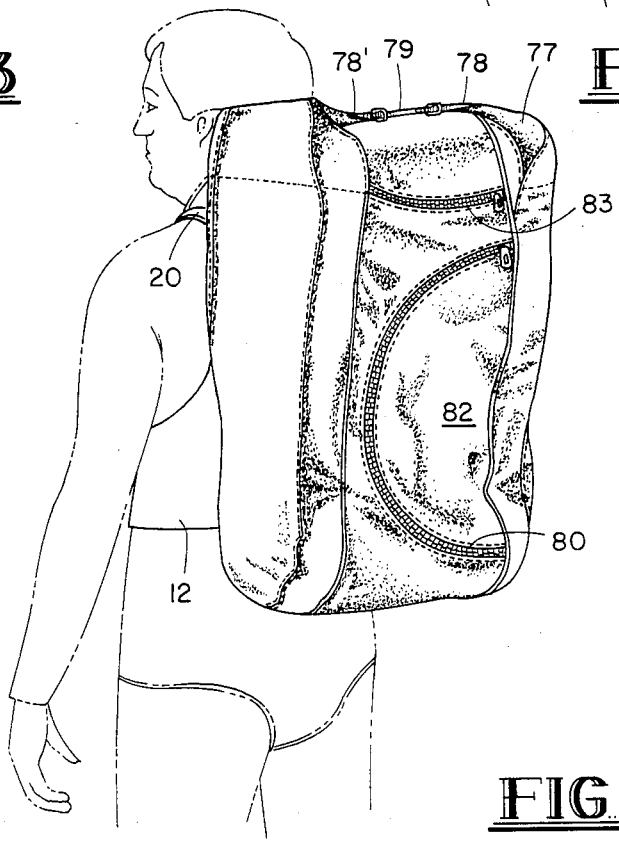
FIG. 15 illustrates the backpack and equipment bag of the underwater diving system of the present invention on a diver in the carrying position.

A further feature of the system of the present invention is the ease with which the equipment may be carried by the diver. As pointed out in the background above, it is necessary, of course, for the diver to carry the equipment through airports and the like, and also daily when traveling to and from the dive boat. In order to facilitate that transport of the dive equipment, equipment bag 90 has two (2) diagonal loops 93 and 95 (FIG. 9 and FIG. 11) sewn to the back thereof. As shown in FIG. 9, backpack 10 can be detached from equipment bag 90 and shoulder supports 20 and 22 looped through the diagonal loops 93 and 95. The diver may then carry his entire bag of equipment as necessary as shown in FIG. 15.

Thus, the custom underwater diving system of the present invention provides a totally integrated diving system. The backpack integrates with the equipment bag, providing for complete structural protection during shipment, and also integrates with the equipment bag to allow the bag and the diving equipment to be carried through airports and to and from dive sites. The backpack is light-weight and adjustable to the particular requirements of each diver, and uses a single waist strap and open-type shoulder supports allowing for easy entry and exit. The bouyancy compensator permits a choice of two positions. In the optional back position, it allows for an uncluttered chest, improving ease of movement, use of underwater photographic equipment and other diving apparatus. In the standard frontal position, the bouyancy compensator moves to a frontal position to allow a diver to float in an upright position at the surface for comfort and safety and still provide ease of movement through the water during the dive. Additionally, the equipment bag is designed to organize and protect the various items of dive equipment used, in addition to providing a "dry" area for clothing, towels, and other materials desired to be kept dry.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

We claim:

1. A diver's backpack for carrying an air source and weights, adjustable to conform to a diver's body comprising:

a back portion having slots for releasably securing an air tank thereto;

semi-rigid, spaced, open shoulder support means extending from said back portion for carrying said backpack on the shoulders of a diver wherein said shoulder support means are malleable and capable of being selectively formed into individual radii of curvatures to conform to an individual diver's body which radii of curvature are substantially retained once formed;

means for releasably securing said backpack to a diver's torso;

at least one weight cavity formed in said back portion and adapted for receiving diving weights; and means for releasably retaining weights in said at least one weight cavity.

2. A backpack as in claim 1, wherein said at least one weight cavity comprises:

two weight cavities formed in said back portion having openings in the lower ends thereof and means for releasably retaining weights in said two weight cavities, wherein said weight cavities are spaced and extend longitudinally on both sides of the longitudinal axis of said back portion of said backpack forming two parallel ridges and creating a cradle for an air tank.

3. A backpack as in claim 2 wherein said means for releasably retaining weights in said weight cavities comprises:

two weight cavity door means sized to fit within said openings and connected by a flexible connecting member; and means for releasably connecting said two weight cavity door means to said backpack such that said door means are releasably retained in said openings.

4. A backpack as in claim 1, wherein said backpack is formed with an embedded malleable metal skeleton extending around said slots and into said shoulder supports.

5. A bouyancy compensator for use in underwater diving and adapted to be carried behind a diver's torso, comprising:

a pneumatic inflatable chamber having a top portion and two downwardly extending leg portions forming an inverted elongated U shape;

means for selectively inflating said pneumatic chamber;

means for releasably mounting said pneumatic chamber to a diving backpack; and means attached at the lower ends of said two downwardly extending leg portions for forming at least two operable positions for said bouyancy compensator, a first position wherein said lower ends are connected in front of the diver's torso, and a second position wherein said lower ends are connected behind the diver's torso.

6. A bouyancy compensator as in claim 5 wherein said bouyancy compensator further comprises:

two elbow portions formed in each of said two legs wherein said elbow portions have an inner and outer radii, said inner radius being shorter than said outer radius, and wherein said inner radius is disposed toward the front of said legs such that upon inflation of said chamber said elbow portions will cause said legs to move forward in front of a diver's torso.

7. A bouyancy compensator as in claim 6 wherein said elbow portions are formed proximal to the joint between said two legs and said top of said chamber.

8. A bouyancy compensator as in claim 5, wherein the lower ends of said legs are formed having an inner and outer radii, wherein said inner radius is shorter than said outer radius, and wherein said difference in radii cause said ends of said legs of said pneumatic chamber to move together upon inflation of said pneumatic chamber.

9. A bouyancy compensator as in claim 5 further comprising:

an outer covering shaped to conform to the shape of said pneumatic chamber and having sleeves extending down the inner sides of said downwardly extending legs; and flexible stays for insertion in said sleeves for maintaining said legs in an extended position, said stays having means for securing said stays to air tank retaining means at one end thereof, wherein said bouyancy compensator may be removably attached to a diver's backpack through said air tank retaining means.

10. A bouyancy compensator as in claim 9, wherein said stay means are tractable to provide flexion when said pneumatic chamber is inflated.

11. An equipment bag for protecting and transporting diving equipment comprising:

a generally rectangularly shaped container having a front, back, two ends, and two sides;

pockets formed on both sides of said container sized to receive diving fins;

a semi-rigid protective sheath covering said two ends and said back of said container;

means formed in the front of said container for access to the interior of said container;

dividers in said container forming separate compartments adapted to receive items of diving equipment and retain the more fragile of said items in a protected position in said equipment bag; and means for releasably securing a diver's backpack to the exterior of said equipment bag in at least two positions, a first, shipping position wherein said backpack is releasably secured in a position covering said front of said equipment bag, and a second, carrying position wherein said equipment bag is releasably secured to said backpack such that said backpack allows said equipment bag to be carried and supported by the shoulders of a diver.

12. An underwater diving system for convenient transport and use of underwater diving equipment comprising:

a backpack having means for releasably securing an air tank thereto, and having means for supporting said backpack on the body of a diver;

said means for supporting said backpack on the body of a diver comprising two malleable, open, spaced support arms adjustable to conform to the shoulders of a diver; and an equipment bag having means for releasably securing a diver's backpack to the exterior of said equipment bag in at least two positions, a first, shipping position wherein said backpack is releasably secured in a position covering said front of said equipment bag, and a second, carrying position wherein said equipment bag is releasably secured to said backpack such that said backpack allows said equipment bag to be carried and supported by the shoulders of a diver.

13. An underwater diving system as in claim 12, wherein said equipment bag further comprises:

a semi-rigid sheath covering two ends and one side of said equipment bag;

such that when said backpack is secured in said shipping position said backpack substantially covers the side of said equipment bag opposite said sheath.

14. An underwater diving system as in claim 13, wherein said equipment bag further comprises:

compartments formed along the sides of said equipment bag sized for receiving diver's swimming fins such that said fins upon insertion in said compartments provide protection for the contents of said bag along the sides of said bag.

15. An underwater diving system as in claim 12, wherein said means for detachably mounting said equipment bag to said backpack in a position to be carried by said backpack comprises: two diagonally positioned straps secured to the back of said bag and positioned to allow said shoulder supports of said backpack to be slipped through said straps thus permitting carrying of said equipment bag on said backpack.

16. An underwater diving system, as in claim 12, wherein said backpack further comprises:

at least one cavity formed in said backpack for retaining diving weights; and means for releasing said diving weights from said compartment.

17. An underwater diving system as in claim 12, wherein said shoulder support means of said backpack comprises: malleable projecting members which may be bent forward and downward at a radius adjustable to fit comfortably over the shoulders of a diver.

18. An underwater diving system as in claim 12 further comprising:

an inflatable bouyancy compensator having means for detachably mounting said bouyancy compensator on said backpack, and wherein said bouyancy compensator is in a substantially inverted U shape having two downwardly extending arms and having means for optionally, releasably retaining the free ends of said arms of said bouyancy compensator in one of two positions, a first position behind the torso of a diver, and a second position in front of the torso of a diver.

19. An underwater diving system as in claim 18, wherein said bouyancy compensator further comprises: means for urging the free ends of the arms of said bouyancy compensator upward and forward when said bouyancy compensator is inflated.

20. An underwater diving system as in claim 19, wherein said means for urging said free ends of said arms of said bouyancy compensator upward and forward comprises: elbow portions having inner and outer radii wherein said inner radius is shorter than said outer radius and wherein said elbow portions are formed in each arm of said bouyancy compensator and disposed so as to urge the arms of said bouyancy compensator, when inflated, around the torso of a diver carrying said bouyancy compensator.

* * * * *